US005957333A

United States Patent [19]

Losenno et al.

[11] Patent Number: 5,957,333

[45] Date of Patent: Sep. 28, 1999

[54] AEROSOL SPRAY CONTAINER WITH IMPROVED DISPENSING VALVE ASSEMBLY

[75] Inventors: Christopher D. Losenno, Edina; William M. Mower, Plymouth; Gino L. Losenno, Edina, all of Minn.

[73] Assignee: Pure Vision International L.L.P., Minneapolis, Minn.

[21] Appl. No.: 09/136,938

[22] Filed: Aug. 20, 1998

Related U.S. Application Data

[63] Continuation-in-part of application No. 09/013,371, Jan. 26, 1998.

[51] Int. Cl.[6] ..... B65D 35/28; B65D 38/00; B67D 5/42; B05B 7/32

[52] U.S. Cl. ..... 222/95; 222/105; 222/402.1; 222/402.16; 222/386.5; 239/337

[58] Field of Search ..... 222/402.1, 402.16, 222/402.18, 95, 105, 386.5; 239/337

[56] References Cited

U.S. PATENT DOCUMENTS

| | | | |
|---|---|---|---|
| 3,169,670 | 2/1965 | Hrebenak et al. . | |
| 3,559,701 | 2/1971 | Wittersheim et al. . | |
| 3,583,606 | 6/1971 | Ewald . | |
| 3,592,390 | 7/1971 | Morse . | |
| 3,675,825 | 7/1972 | Morane . | |
| 3,731,854 | 5/1973 | Casey | 222/402.1 |
| 3,792,802 | 2/1974 | Gores . | |
| 3,827,608 | 8/1974 | Green . | |
| 3,838,796 | 10/1974 | Cohen . | |
| 3,901,416 | 8/1975 | Schultz . | |
| 4,147,284 | 4/1979 | Mizzi . | |
| 4,482,082 | 11/1984 | Goncalves . | |
| 4,492,320 | 1/1985 | Tada . | |
| 4,513,890 | 4/1985 | Goncalves . | |
| 4,619,297 | 10/1986 | Kocher . | |
| 4,646,947 | 3/1987 | Stull . | |
| 4,813,575 | 3/1989 | O'Connor . | |
| 4,856,677 | 8/1989 | Brunet et al. | 222/95 |
| 4,921,020 | 5/1990 | Pamper . | |
| 4,925,066 | 5/1990 | Rosenbaum . | |
| 4,953,753 | 9/1990 | Gortz . | |
| 4,984,717 | 1/1991 | Burton . | |
| 5,165,576 | 11/1992 | Hickerson . | |
| 5,224,528 | 7/1993 | Helmut et al. . | |
| 5,232,126 | 8/1993 | Winer | 222/95 |
| 5,265,765 | 11/1993 | Maier | 222/402.1 |
| 5,507,420 | 4/1996 | O'Neill . | |
| 5,623,974 | 4/1997 | Losenno et al. | 222/402.1 |
| 5,695,096 | 12/1997 | Yquel . | |
| 5,730,328 | 3/1998 | Maeder et al. | 222/95 |
| 5,839,623 | 11/1998 | Losenno et al. | 222/402.1 |

*Primary Examiner*—Andres Kashnikow
*Assistant Examiner*—Keats Quinalty
*Attorney, Agent, or Firm*—Nikolai, Mersereau & Dietz, P.A.

[57] ABSTRACT

An aerosol spray can or bottle is described incorporating a dispensing valve for blending a liquid product contained within a compressible compliant inner container that is suspended within an outer vessel whose interior is pressurized with air or other suitable gas. In each of the embodiments described, the structure for suspending the compliant container for the product includes a socket in which a valve body member and first and second seals are contained. A push-button having a spray nozzle is affixed to a spring-biased plunger and when the push-button is not being depressed, the first seal member precludes flow of the pressurizing gas to a mixing chamber and second seal member blocks the flow of the liquid product into the mixing chamber. Depression of the push-button operates to displace the first and second valves permitting a portion of the pressurizing gas to mix with the product to be dispensed in the mixing chamber before exiting the spray nozzle.

17 Claims, 8 Drawing Sheets

AEROSOL SPRAY CONTAINER WITH IMPROVED DISPENSING VALVE ASSEMBLY

I. CROSS REFERENCE TO RELATED APPLICATIONS

This is a continuation-in-part of application Ser. No. 09/013,371, filed Jan. 26, 1998 and entitled "AEROSOL SPRAY CONTAINER WITH IMPROVED DISPENSING VALVE ASSEMBLY". In addition, this application relates to the subject matter of copending application Ser. No. 08/688,657, filed Jul. 29, 1996, and entitled "Reusable Pressure Spray Container", and Ser. No. 08/787,259, filed Jan. 24, 1997, and entitled "Spray Bottle With Built-In Pump".

BACKGROUND OF THE INVENTION

II. Field of the Invention

This invention relates generally to spray bottle product dispensing apparatus, and more particularly to a pressurized container in which the pressurizing fluid is isolated from the product to be dispensed as a spray until the moment of release and in which the valving mechanism employed has been simplified to reduce cost and improve performance.

III. Discussion of the Prior Art

In application Ser. No. 08/688,657, filed Jul. 29, 1996, and entitled "REUSABLE PRESSURE SPRAY CONTAINER", there is described an aerosol spray dispenser system in which the liquid product to be dispensed as an aerosol is contained within a compliant, flexible inner container suspended in an outer vessel where the outer vessel is pressurized with a suitable gas so as to exert compressive forces against the inner compliant container. Means are also provided therein for mixing or blending a portion of the pressurizing gas with product as it leaves its container when the dispensing valve assembly is actuated.

As is pointed out in the introductory portion of that application, a particular problem arises when limitation is placed on the concentration of lacquer solvent, generally alcohol must be reduced because of governmental regulations. With less solvent, there is a propensity for the product to congeal and gum up the dispensing valve mechanism.

The present invention is directed to an improved dispensing valve arrangement for an aerosol container of the type generally described in my aforereferenced application. In the present invention, the reliability of the valve mechanism has been improved and the overall cost of manufacture thereof has been significantly reduced.

SUMMARY OF THE INVENTION

The present apparatus for dispensing the liquid as an aerosol from a gas pressurized vessel comprises a compliant, compressible container for containing a liquid to be dispensed as an aerosol. The container has an open neck and an elongated, hollow, generally cylindrical body with a pattern of longitudinally extending, parallel, spaced ridges formed on the inner wall thereof. The compliant container is suspended by its open neck within an outer vessel that is pressurized by air or other suitable gas. The device that suspends the container has a valve-receiving socket incorporated in it along with a passage that provides a first fluid path from an interior of the pressurized vessel to the valve receiving socket. A valve body member having a base portion fitted into the socket cooperates with a first, flexible seal member that normally occludes the passage forming the first fluid path when the valve body member is not being manually depressed. The base portion of the valve body member also includes a second fluid path having an inlet and an outlet where the inlet is exposed to an interior of the compliant container through its open neck. The second flexible seal member is disposed in the socket and cooperates with the valve body member for normally blocking fluid flow from exiting the second fluid path outlet when the valve body member is not being depressed. Completing the assembly is a spring-biased push-button having a spray nozzle disposed in it. The push-button is coupled to the valve body member such that depression of the push button simultaneously deforms the first and second flexible seal members so that the liquid to be dispensed can pass through the second fluid path to mix with a portion of the gas pressurizing the vessel before the mixture exits the nozzle.

Several embodiments of the invention involving variations in the seal configurations are described.

DESCRIPTION OF THE DRAWINGS

The foregoing features, advantages and objects of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
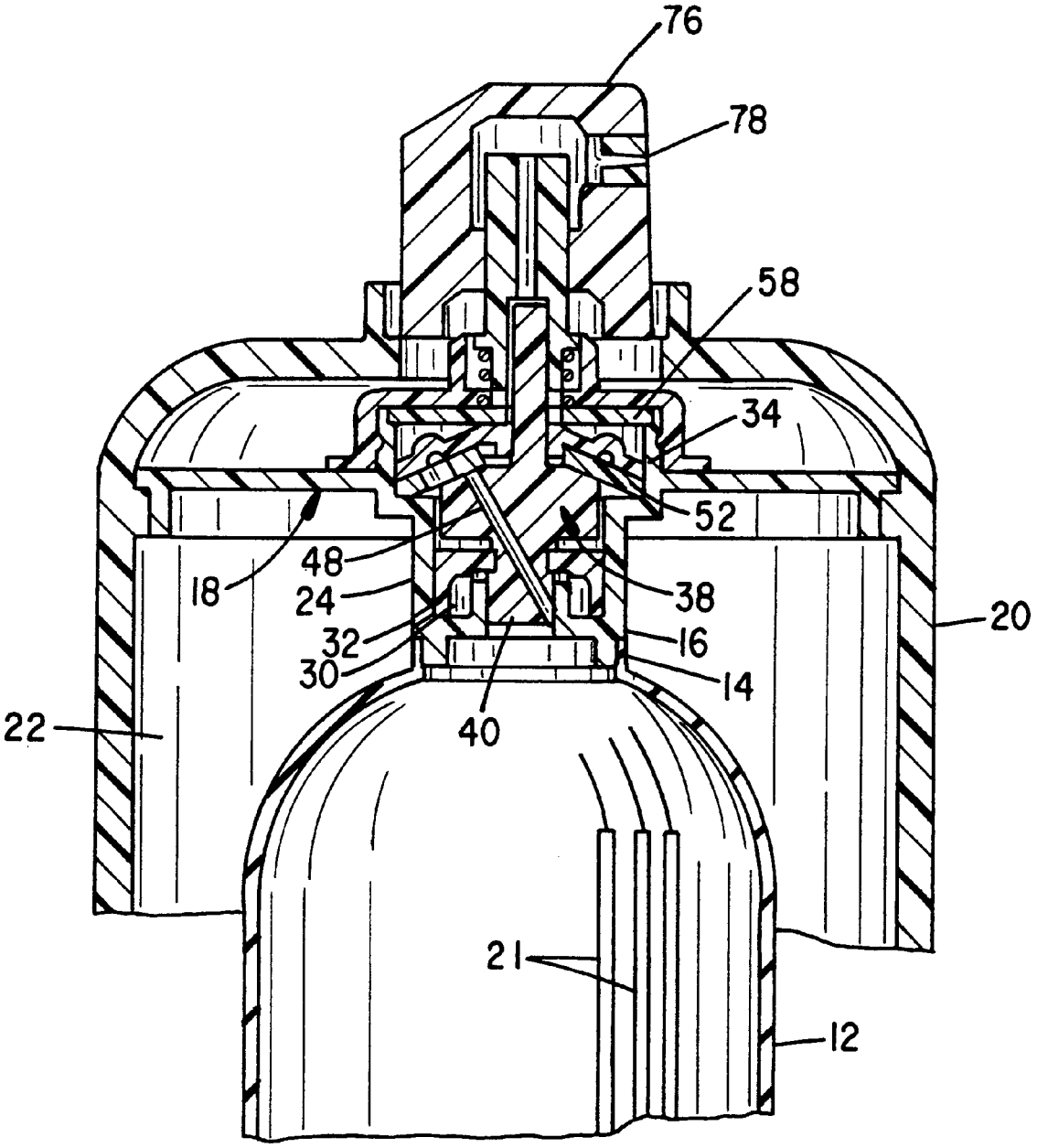
FIG. 1 is a partial cross-sectional view of an aerosol spray can constructed in accordance with the present invention and incorporating a first valve design.

The aerosol dispensing valve of the present invention is designed to be used with a compliant, compressible and extensible, elastomeric inner container 12 in which the liquid product to be dispensed is held. The compliant container is generally cylindrical and has an open neck 14 that is integrally formed with or bonded to the lower end of a valve receiving socket 16 of a valve support plate 18 which is fitted into and supported by an outer vessel 20 proximate the upper end thereof. The valve support plate thus suspends the complaint container 12 within the vessel 20. Formed on the interior wall of the compliant container is a pattern of longitudinally extending, parallel, spaced-apart ridges 21 which function to maintain an open fluid path, even when the container collapses as the product is emptied from it.

This allows practically all of the contents of the compliant container to be expelled.

As is described in my aforereferenced pending patent applications Ser. Nos. 08/688,657 and 08/787,259, the chamber 22 defined by the outer vessel 20 in which the compliant container is suspended is pressurized by air or other appropriate gas, either by a built-in manually operable pump or by introduction of the pressurizing fluid through a valved orifice (not shown). With continued reference to FIG. 1 and to FIG. 2, which shows an exploded view of the valve assembly of the present invention, the valve support plate 18 is seen to include a valve receiving socket 16 having an outer cylindrical wall 24 concentrically disposed about an inner cylindrical wall 26 that is supported by an annular web 28. The annular cavity or recess 30 formed between the outer wall of the inner cylindrical wall 26 and the inner surface of the outer cylindrical wall 24 contains an annular elastomeric cup seal 30 therein.

Formed through the outer wall 24 of the valve receiving socket 16 is a fine diameter bore 32 whose lower outer end is exposed to the pressurizing fluid contained in the chamber 22 of the vessel 20 and whose inner end is normally blocked by the cup seal 30 to prevent flow of the pressurizing fluid through the fine bore 32.

Integrally formed atop the outer cylindrical wall 23 of the valve support member 18 is a cylindrical collar 34. Projecting radially outward from this collar is an annular disk-like flange 36 which abuts and is supported on the inside wall of the outer vessel 20 to form an air or gas impervious seal therebetween.

Numeral 38 identifies a valve body member having a cylindrical base portion 40 of a first predetermined diameter adapted to fit into and seal against a center opening in cup seal 30, an intermediate cylindrical portion 42 of a larger diameter and an upper stem portion 44 of a lesser diameter than either the base portion or the intermediate portion. As can best be seen in the exploded view of FIG. 2, a longitudinally extending slot or groove 46 is formed in the exterior surface of the stem portion. The depth and width of the groove 46 is tailored to the viscosity of the product to be dispensed with a smaller cross-section reserved for less viscous liquids. A diagonal bore 48 is drilled or otherwise formed so as to extend from the bottom of the base portion 40 to a beveled edge 50 on the upper surface of the intermediate portion 42. The lower end of the diagonal bore 48 is exposed to the interior of container 12.

The outer diameter of the base portion 40 is dimensioned to fit through the opening defined by the inner cylindrical wall 26 formed in the socket 16 of the valve support member 18 with a sliding fit. The diameter of the intermediate portion 42 allows it to move freely up and down within the spaced defined by the outer cylindrical wall 24 of the valve receiving socket 16 of the valve support plate 18. The stem portion 44 of the valve body 38 extends through the center opening of a flexible, frustoconical-shaped elastomeric seal member 52. The angle or slope of the seal member 52 corresponds to that of the beveled shoulder 50 on the valve body 38 and normally is in sealing relation to the diagonal bore 48 formed in the valve body.

Also fitted over the stem portion 44 of the valve body and overlaying the elastomeric frustoconical seal member 52 is a flexible spring member 54. It is also somewhat frustoconical in shape and has a central, integrally formed tubular portion 56 projecting downward from the undersurface thereof to wedge between the seal member 52 and the stem portion 44 of the valve body.

Resting atop the flexible, conical spring member 54 is an elastomeric washer 58 having a central opening whose diameter closely fits against and cooperates with the stem portion 44 of the valve body 38.

A cap member 60 also fits over the stem portion of the valve body and is in covering relation to the washer seal 58, the flexible spring member 54, the frustoconical seal member 52 and the intermediate and base portions of the valve body 38. Projecting outwardly from the inner cylindrical wall of the cap 60 is an annular bead 62 that is adapted to snap into an annular recess or groove 64 formed inwardly into the outer surface of the upwardly projecting collar portion 34 of the valve support plate 18. In this fashion, the cover or cap 60 becomes positively affixed to the valve support plate.

Figure 2:
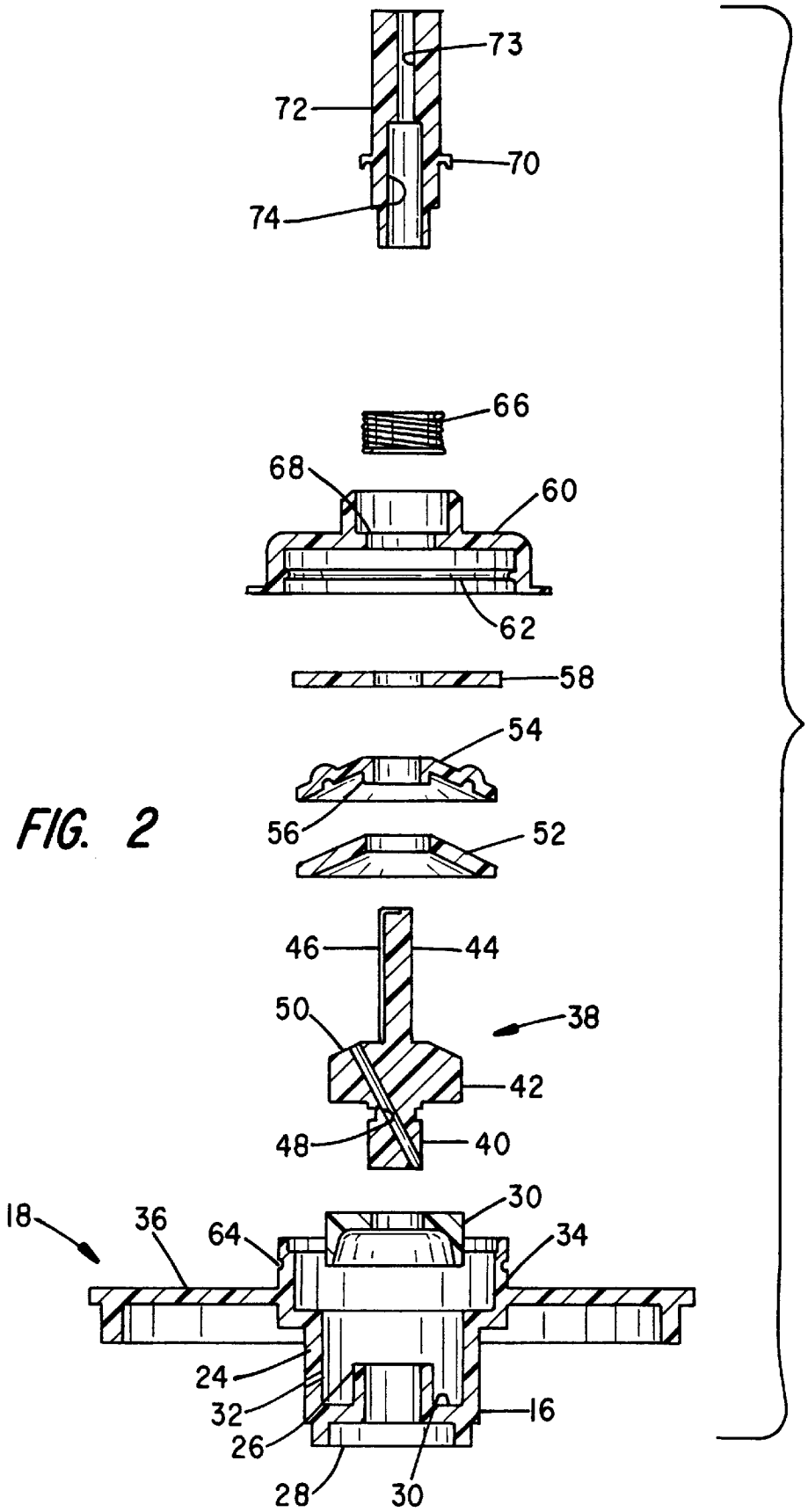
FIG. 2 is an exploded view of the valve assembly incorporated in the embodiment of FIG. 1.

As can perhaps be best seen in the exploded view of FIG. 2, a compression-type helical spring 66 cooperates at its lower end with an inwardly extending grooved flange 68 formed in the cover member 60 and at its upper end with a radially extending flange 70 formed on the exterior cylindrical surface of a tubular valve plunger 72. The plunger 72 has a central bore 74 whose diameter receives the stem portion 44 of the valve body 38 therein with a firm friction fit. A push-button nozzle 76 (FIG. 1) fits onto the upper end of the plunger. The nozzle has a fine orifice 78 through which the aerosol spray may exit the assembly in a manner yet to be described.

With reference to FIG. 1, when the push-button 76 is not being depressed by the user's finger, the cup seal 30 is in covering relation with respect to the fine bore 32, precluding the pressurizing gas in chamber 22 from escaping from the vessel 22. The pressurizing gas does, however, act on the compliant walls of the product container 12 to squeeze the liquid from container 12 into the inclined bore 48 formed in the valve body, but that liquid is blocked from exiting the diagonal bore by the frustoconical seal member 52 that is held firmly against the beveled shoulder 50 of the valve body at the exit end of the diagonal bore.

When the push-button and plunger are depressed against the force of the helically coiled return spring 66, the flexible spring and the frustoconical elastomeric seal are distorted so that the frustoconical seal member 52 lifts away from the beveled shoulder of the valve body, allowing the liquid under pressure to flow out through the diagonal bore 48 in the valve body. At the same time, the downward pressure of the valve body against the upper surface of the annular elastomeric cup seal 30 also deforms that seal so that it no longer closes against the fine bore 32 formed through the cylindrical wall of the valve receiving socket 16, allowing the air or gas used to pressurize the vessel to flow through this bore 32 and up into the space beneath the now-distorted frustoconical elastomeric seal 52 to mix with the liquid to be dispensed. The resulting aerosol spray travels upward through the slit or groove 46 formed longitudinally in the exterior surface of the stem portion of the valve body, through the lumen 73 of the plunger 72 and, thence, out through the spray nozzle orifice 78 in the push-button 76. Subsequent release of finger pressure on the push-button and plunger allows the return spring 66 to lift the valve body 38, allowing the elastomeric cup seal 30 and the frustoconical seal 52 to reseal their respective bores 32 and 48 and thereby shut off the flow of both the liquid product and the pressurizing fluid.

FIRST ALTERNATIVE EMBODIMENT

Figure 3:
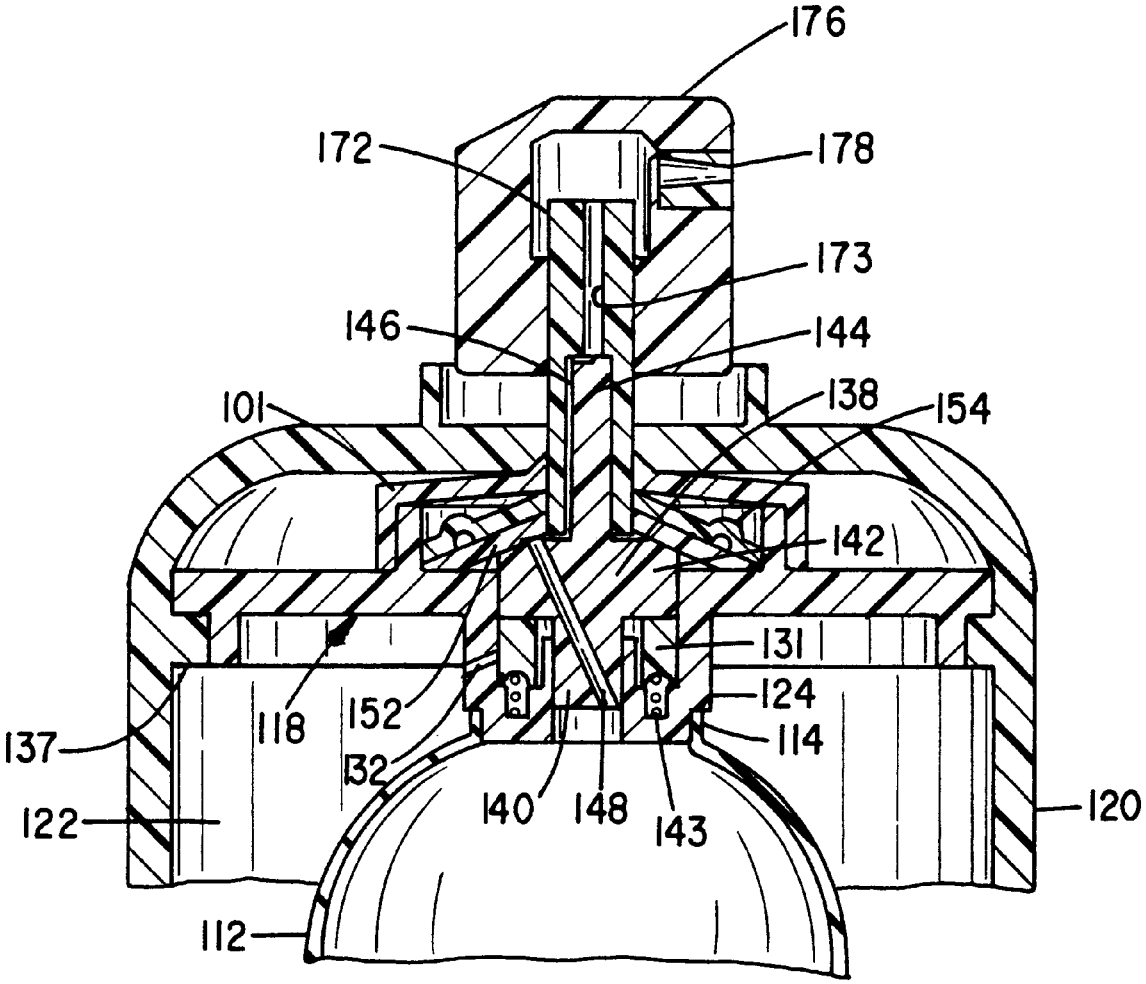
FIG. 3 is a partial cross-sectional view of a first alternative embodiment when the spray push-button is not being depressed.

FIG. 3 depicts a cross-sectional view of a aerosol spray can or bottle when the dispenser valve is not being actuated.

It is quite similar in its construction to the embodiment illustrated in FIGS. 1 and 2 except that the return spring for the valve assembly is relocated.

The aerosol container again comprises a compliant, compressible elastomeric container 112 having a generally cylindrical body with a closed lower end and an open neck 114. A means 118 is provided for suspending the flexible, compliant container 112 by its open neck within a pressurized outer vessel 120. The part 118 includes a generally circular plate or flange 137 supported about its periphery by an annular protuberance 136 and includes an integrally formed socket 124 for receiving a valve body member 138 therein. The socket 124 has a fine bore 132 formed through the wall thereof which provides a fluid path from the interior chamber 122 of the pressurized vessel 120 to the interior of the socket 124.

The valve body member 138 has a stem portion 144, an intermediate portion 142 and a base portion 140, the base and intermediate portions fitting into the valve receiving socket 124. An annular elastomeric seal 131 is disposed in the socket 124 and is normally urged upwardly against the undersurface of a radial flange defined by the larger diameter intermediate portion 142 of the valve body by means of a helical compression spring 143. The elastomeric seal 131 overlays the fine bore or port 132, precluding the flow of the pressurizing gas in the chamber 122 acting on the compliant container 112 from escaping through the bore 132.

The base and intermediate portions 140 and 142 of the valve body member 138 include a diagonally sloping bore 148 having its inlet end in fluid communication with the interior of the compliant compressible container 112 and its outlet end leading to a beveled shoulder on the intermediate section 142 of the valve body.

Formed inwardly from an exterior surface of the stem portion 144 of the valve body is a longitudinally extending groove 146. A flexible seal member 152 having a generally frustoconical shape normally occludes the outlet end of the bore 148. It is disposed in the valve receiving socket and surrounds the stem portion of the valve body. A tubular plunger 172 has a longitudinal bore formed therethrough into which is fitted the stem portion 144 of the valve body member 138. The plunger includes a counterbore 173 leading to a chamber formed in a push-button 176 that has an outlet dispensing nozzle 178.

Figure 4:
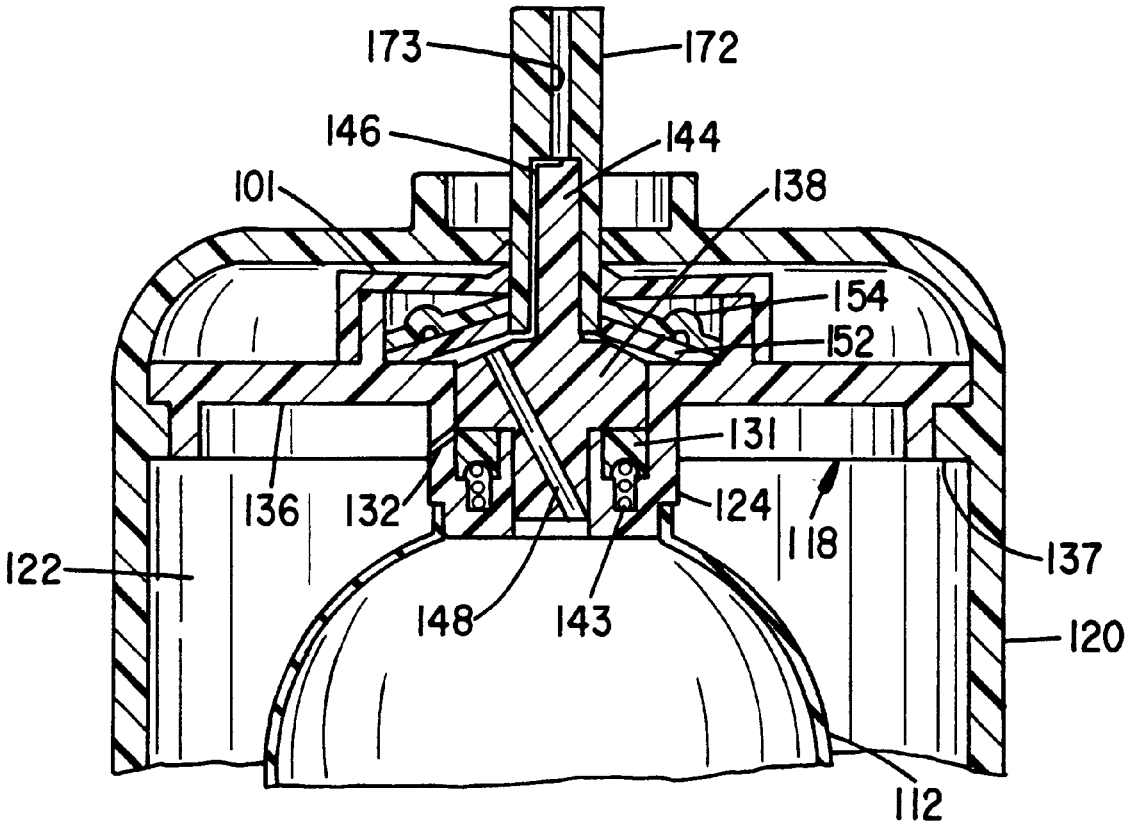
FIG. 4 is a cross-sectional view of the embodiment of FIG. 3 with the push-button being depressed.

Referring to FIG. 4, upon depression of the plunger 172 against the resistance offered by the coil spring 143, the seal member 131 is displaced from the inner end of the fine bore 132, which permits pressurizing gas in the chamber 122 to flow through that bore and into the space occupied by the flexible frustoconical seal member 152. Depression of the plunger 172 also distorts the seal 152 such that the liquid to be dispensed which is being compressed by the pressurizing gas acting on compliant container 112 may now flow through the diagonal bore 148 into that same space where it mixes with the pressurizing gas to form a mixture which flows up the longitudinal groove 146 in the stem 144 and through the counterbore 173 in the plunger. The gas/liquid mixture is forced out through the nozzle 178 and a fine spray.

Subsequent release of the push-button 176 allows the return spring 143 to return the valve body 138 to a position where the fine bore 132 and the diagonal bore 148 again becomes sealed against further flow of pressurizing gas and liquid product.

In the alternative embodiment illustrated in FIGS. 3 and 4, a plastic cap 101 fits over the socket 124 and has a deflectable dome which is slightly convex when the push-button 176 is not being depressed (FIG. 3), but which becomes slightly concave when the push-button is actuated (FIG. 4). The flexing of the dome of the cap 101 acts through a plastic spring member 154 to cause the frustoconical seal 152 to distort and become displaced relative to the outlet of the diagonally extending bore 148.

SECOND ALTERNATIVE EMBODIMENT

Figure 5:
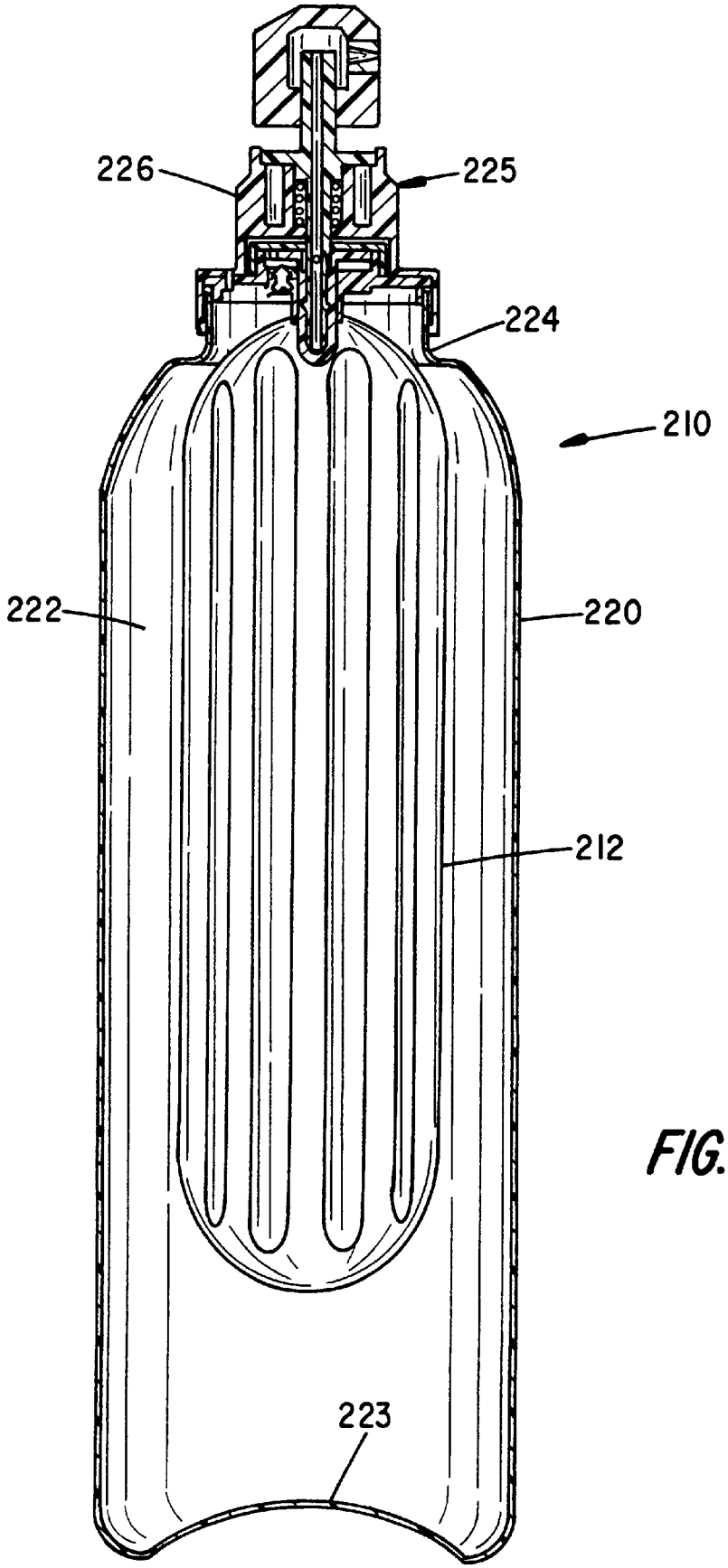
FIG. 5 is a cross-sectional view of an aerosol spray bottle incorporating a second alternative spray valve assembly.
Figure 6:
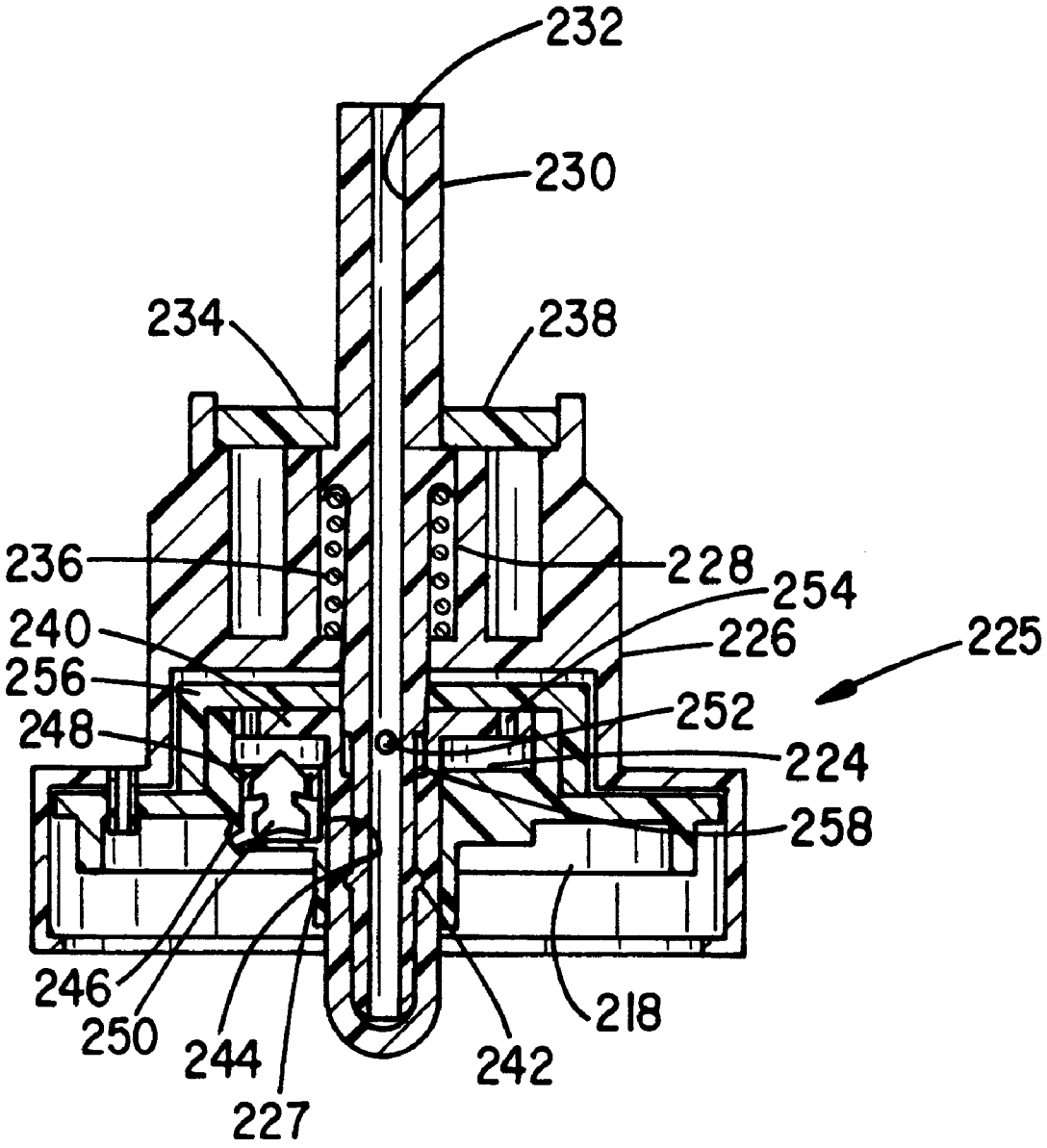
FIG. 6 is an enlarged view of the spray assembly portion of the spray bottle of FIG. 5.

FIG. 5 is a side cross-sectional view of a second alternative embodiment of the present invention and FIG. 6 is an enlarged view of the dispenser valve assembly used therein. The aerosol spray container 210 comprises an outer vessel 220 defining a chamber 222 having a closed bottom 223 and an open top or neck 224. Crimped, screwed or otherwise bonded to the neck 224 is a dispenser valve assembly indicated generally by numeral 225. It includes an outer cover 226 having a central bore 228 formed therein into which is fitted a tubular plunger 230 having a central lumen 232 extending the length thereof. The plunger 232 has a radially extending flange 234 and positioned between that flange and the base of the bore 228 in the cover 226 is a helical compression return spring 236 which normally urges the plunger 230 upward such that the flange 234 abuts a disk insert member 238.

The cap 226 fits about a molded plastic valve support member 218 having a valve receiving socket 224 formed therein and a downwardly depending collar 227 from which is suspended the interior compliant flexible elastomeric product container 212. That is, the open neck of the container 212 is affixed to the collar 227 and hangs within the outer container or vessel 220 as clearly seen in FIG. 5.

A valve body member is identified by numeral 240 and resides within the valve receiving socket 224.

The lower end of the plunger 230 fits into a tubular bore formed in the valve body member 240 with a tight friction fit afforded by a detent ring 242 mating with a corresponding detent recess in the valve body member.

As can be seen in the enlarged view of FIG. 6, annular grooves as at 244 are formed in the exterior side wall of the tubular portion of the valve body member 240, but the grooves 244 terminate short of the lower end of the annular collar 227 to which the neck of the container 212 is affixed. Hence, with the valve plunger 232 unactuated, the liquid contents of the compliant, compressible container 212 is blocked from flowing through the grooves 244. The valve support member 224 has a bore 246 formed through its thickness dimension and fitted into this bore is a valve seat 248. Cooperating with the valve seat is an elastomeric valve member 250 having a conical tip extending through the annular valve seat into the interior of the socket of the valve support member 218. When the plunger 230 is not depressed, the valve member 250 precludes the pressurizing gas in the chamber 222 from flowing through the valve seat 248 into the chamber defined by the socket of the valve support plate.

When the push-button like that of 176 in FIG. 3 is mounted on the upper end portion of the plunger 230 and is depressed, the return spring 228 is likewise compressed as the intermediate portion 240 of the valve body moves downward. When fully depressed, the lower ends of the grooves 244 become exposed beneath the collar 227 and the liquid product within the compliant container 212 may flow up these grooves and into the chamber defined by the socket portion of the valve support member 218. At the same time, the conical end portion of the elastomeric valve member 250 is pushed down by the intermediate portion 240 of the valve body, unseating the valve 250 from the valve seat 248 and permitting the pressurizing gas to also flow into the chamber defined in the socket 224. The mixture of gas and product then flows through a small bore 252 formed through the side wall of the plunger 230 and into its lumen 232. The aerosol mixture flows through the lumen and ultimately out the nozzle in the push-button (not shown in FIG. 6) that is assembled onto the upper end of the plunger 230.

The path for the gas/product mixture in reaching the aperture 252 in the plunger 230 is through ports, as at 254, formed through the intermediate portion 240 of the valve body member and thence along the elastomeric seal 256 and into an annular counter bore 258 in the valve body member 218, the counter bore having a diameter somewhat larger than the diameter of the plunger 230.

THIRD ALTERNATIVE EMBODIMENT

Figure 7:
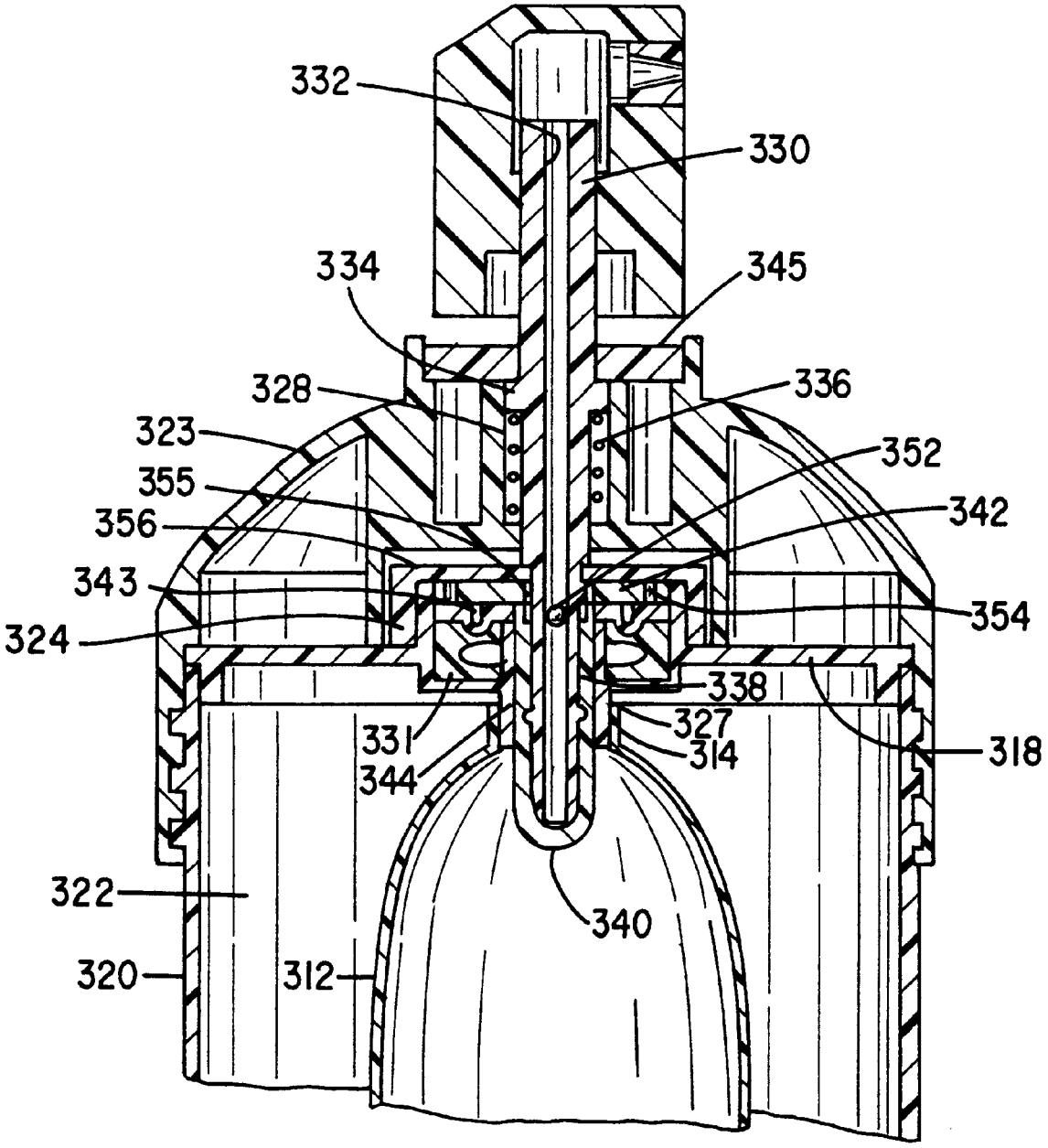
FIG. 7 is a partial sectional view of a third alternative embodiment of a spray bottle made in accordance with the present invention.

FIG. 7 illustrates yet another embodiment of the present invention. In this arrangement, the valve configuration is somewhat similar to the embodiment of FIGS. 5 and 6 except that the valve for controlling flow of the pressurizing gas into the chamber where it is to mix with the liquid to be dispensed as an aerosol has been modified. Referring to FIG. 7, there is again an outer vessel 320 having a valve support member 318 supported thereby, the valve support member including an annular valve receiving socket 324 formed therein. Depending from an undersurface of the valve support member 318 is an annular collar 327 to which the open neck 314 of the inner compressible compliant container 312 is affixed. Fitted into the socket 324 of the valve support member 318 is a valve body member 338. The stem body has a base portion 340 which is generally tubular and an intermediate portion 342 that comprises an annular flange having an annular protuberance 343 projecting downwardly from an undersurface thereof. Disposed in the socket 324 of the valve support plate 318 is an elastomeric cup seal 330 that normally seats against the inner wall of the socket 324.

As in the embodiment of FIGS. 5 and 6, the lower portion 340 of the valve body member has a plurality of longitudinal grooves 344 formed in the outer surface thereof. When the push-button is not being depressed, the collar 327 of the valve support member 318 extends downwardly below the lower ends of the groove 344 and cooperates with the base portion 340 of the valve body member to block any flow of liquid product out of the container 312, via the grooves 344.

A tubular plunger 330 has its lower end fitted and locked into the centrally located longitudinal bore formed in the valve body member. The plunger has a radial flange 334 extending outwardly therefrom and a compression-type helical spring 336 cooperates with it and with the floor of a central bore 328 formed in a cap member 323. As such, the plunger 330 is normally urged upward to the point where the flange 334 engages the undersurface of an annular disk 345.

Also cooperating with the valve support plate 318 is a cup-shaped elastomeric seal 356 that has a central aperture through which the tubular plunger 330 extends. This flexible seal 336 normally engages the upper surface of the intermediate portion 342 of the valve body member 338 and precludes the flow of any fluid between it and the portion 342 of the valve body.

The plunger 330 has a central lumen 332 extending the full length thereof and proximate the location of the portion 342 of the valve body member 338 is a circular bore or port 352 that extends through the wall of the plunger from its exterior to its lumen 332.

Having described the construction of the third alternative embodiment, consideration will next be given to its mode of operation.

As in each of the previous embodiments, a pressurizing gas is introduced into the chamber 322 defined by outer vessel 320 and it acts upon the liquid to be dispensed from the inner, compliant, flexible, extensible container 312 to force it through the valve assembly. With the plunger 330 in its at-rest (non-depressed) position as illustrated in FIG. 7, the liquid to be dispensed is precluded from flowing through the series of longitudinal grooves formed in the exterior surface of the lower portion of the valve body member 338 because at this time the grooves do not extend beyond the lower end of the collar 327. Moreover, the cup seal member 331 seal tightly against the inner walls of the socket 324 preventing the escape of the pressurizing gas from the chamber 322.

By depressing the plunger 330, several things happen. First, the valve body member moves downward with the plunger 330 until the lower ends of the grooves 344 project beyond the confines of the cylindrical collar 327. This also causes the seal member 356 to deflect downward. Liquid being squeezed by the pressurizing gas acting on the compliant container 312 is now forced upward through the grooves and into the chamber beneath the cup-shaped seal 356 occupied by the intermediate portion 342 of the valve body member. At the same time, the annular protuberance 343 on the valve body member engages the seal 331, distorting it so as to permit the flow of pressurizing gas between it and the inner surface of the wall defining the socket 334. The mixture of the pressurizing gas with the liquid to be dispensed then traverses upwardly through ports 354 formed through the intermediate section 342 of the valve body member and thence into the clearance bore 358 formed in the valve body member. With the pressurized mixture of gas and product in the clearance space 358, it will flow through the port 352 into the lumen 332 of the plunger 330 and thence out through a nozzle in a push-button cap affixed to the upper end of the plunger as in the earlier described embodiments. Release of the push-button will allow the coil spring 336 to return the plunger 330 to its at-rest position and restoring the seals 356 and 331 to their normally seated state, shutting off flow of product and pressurizing gas.

FOURTH ALTERNATIVE EMBODIMENT

Figure 9:
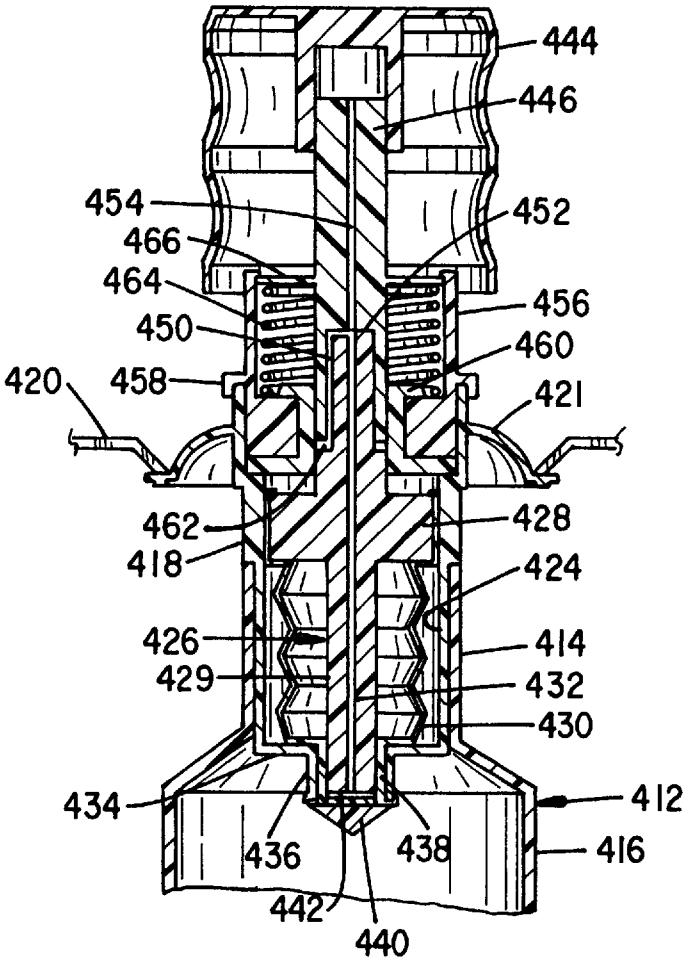
FIG. 9 is a vertical cross-section taken along the line 9—9 in FIG. 8.
Figure 8:
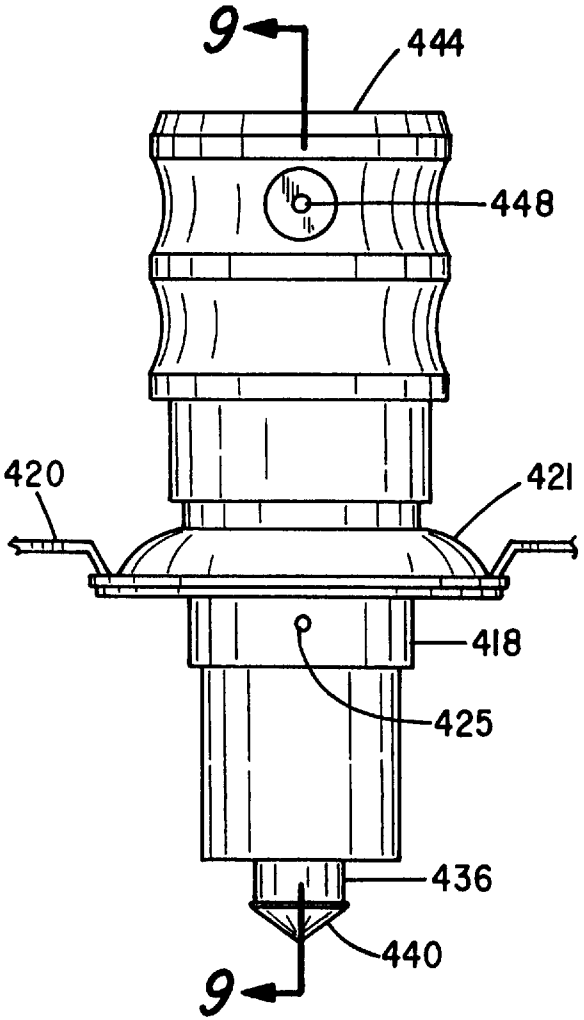
FIG. 8 is a side elevational view of a fourth alternative embodiment of an aerosol spray can made in accordance with the present invention.

FIG. 8 is a front elevational view and FIG. 9 is a cross-sectional view of an alternative valve construction for use with pressurized spray containers for dispensing liquids as a fine mist or aerosol. As in each of the earlier embodiments, it incorporates a compliant, compressible container 412 for containing the liquid to be dispensed. The container has an open neck 414 and an elongated, hollow, generally cylindrical body 416. A tubular valve housing 418 includes an outwardly projecting dome-shaped flange that is adapted to be crimped to a pressurized vessel 420. The flange is identified by numeral 421. The open neck 414 of the compliant compressible container 416 is bonded to an outer wall surface of the cylindrical valve housing 418 so as to be suspended within the pressurized vessel 420.

The valve housing 418 includes a valve receiving socket 424. Formed through the wall of the valve housing is a tiny aperture 425 (FIG. 8) that is in fluid communication with the interior of the pressurized vessel 420. A valve body member indicated generally by numeral 426 includes a base portion 428 in the form of a cylindrical flange extending radially outward from a tubular valve stem portion 429. A lumen 432 extends the length of the valve stem 429.

The base portion 428 supports a flexible plastic bellows member 430 which is designed to wrap about and surround the base portion 428. When inserted into the valve receiving socket 424, the portion of the bellows 430 wrapped about the base member 428 cooperates with the aperture or passage 425 to prevent the pressurizing gas from entering the interior of the valve receiving socket 424.

The valve housing 418 includes an annular shoulder 434 at the lower end thereof and centrally disposed relative to that shoulder is an integrally formed tubular segment 436. A lower end portion 438 of the bellows 430 fits into the tubular segment 436 and cooperates with a conical-shaped end portion 440 on the valve stem 429. When the valve stem 429 is in the position illustrated in FIG. 9, the lower end portion 438 of the bellows 430 functions to seal the exposed ends of radially extending bores 442 that are in fluid communication with the lumen 432 of the valve stem. However, when the push-button 444 fitted onto a tubular plunger member 446 is depressed, the bores 442 descend out of contact with the seal portion 438 of the bellows and the fluid to be dispensed contained within the flexible compliant container 416 is able to flow through the bores 442 and the lumen 432 toward the spray nozzle outlet 448 (FIG. 8). At the same time, depression of the push-button 444 also causes the valve body member 428 to descend below the tiny aperture 425 such that the pressurizing gas within the outer container 420 can flow through the aperture 425 into the interior of the valve receiving socket 424.

Referring back to FIG. 9 again, it is to be noted that the valve stem member 429 includes a longitudinal groove 450 formed in an exterior side wall thereof as well as in a top portion 452 of the valve stem which leads to a lumen 454 in the tubular plunger 446.

Fitted into the upper end of the valve receiving socket 418 is a spring housing member 456 that is preferably ultrasonically bonded to the valve receiving socket 418 about a flange 458. A further elastomeric seal member 460 fits within the spring housing 456 and provides a sliding seal relative to an annular groove 462 defined between the valve stem 429 and the tubular plunger 446. A compression return spring 464 is deployed between a shoulder supporting the elastomeric valve member 460 and a radially projecting flange 466 on the tubular plunger 446, normally urging the valve stem assembly and push button upward as viewed in FIG. 9.

As previously explained, when the push-button 444 is depressed against the return force provided by the spring 464, not only does the liquid to be dispensed flow through radial bores 440 and the lumen 432, but pressurizing gas also flows through the port 425 into the valve receiving socket space 424. When the push-button is depressed sufficiently far, such that the annular grove 462 slides downward past the lower end of the elastomeric valve 460, the pressurizing gas may flow upward through the groove 464 to mix with the liquid product before the combined gas/product mixture is forced out through the spray nozzle port 448.

Those skilled in the art will appreciate that the return spring 464 may alternatively be placed around a lower portion of the valve stem so as to be surrounded by the bellows 430. In that event, the return spring is prevented from being fouled by the liquid product. The spring is also shielded in the position shown in FIG. 9 because liquid product is precluded from reaching the spring by reason of the elastomeric seal member 460.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. Apparatus for dispensing a liquid as an aerosol from a gas pressurized vessel comprising:

(a) a compliant, compressible container for containing the liquid to be dispensed, the container having an open neck and an elongated, hollow, generally cylindrical body;

(b) means for suspending said container by the open neck within the pressurized vessel;

(c) a valve receiving socket formed in the means for suspending, the means for suspending having a passage formed therein for providing a first fluid path from an interior of the pressurized vessel to the socket;

(d) a valve body member having a base portion, the base portion fitting into the valve receiving socket and cooperating with a first, flexible seal member that normally occludes the passage forming the first fluid path from the interior of the pressurized vessel to the socket when the valve body member is not being depressed, the base portion also including a second fluid path having an inlet and an outlet, the inlet adapted to be exposed to an interior of the compliant container through said open neck;

(e) a second flexible seal member disposed in the socket and cooperating with the valve body member for normally blocking fluid flow from exiting the second fluid path outlet when the valve body member is not being depressed; and (f) a spring-biased push-button having a nozzle disposed therein, the push-button coupled to the valve body member, depression of the push-button simultaneously displacing the valve body member relative to the first flexible seal member and the second flexible seal member, allowing the liquid to be dispensed to pass through the second fluid path and to mix with the gas pressurizing the vessel before exiting the nozzle.

2. The apparatus of claim 1 wherein the valve body member further includes:

(a) a stem portion having a longitudinally extending groove formed in an exterior surface thereof with the second flexible seal member surrounding the stem portion and with the spring-biased push-button coupled to the stem portion of the valve body member.

3. The apparatus of claim 2 and further including a tubular plunger for coupling the spring-biased, push-button to the stem portion of the valve body member, an internal lumen of the tubular plunger being in fluid communication with the longitudinally extending groove in the stem portion.

4. The apparatus of claim 2 wherein the first flexible seal member is an elastomeric cup-seal and the second flexible seal member is frusto-conically shaped.

5. The apparatus of claim 2 wherein the valve body member further includes an intermediate portion integrally formed between the base portion and the stem portion, the intermediate portion being of a larger diameter than the base portion and the stem portion, with the intermediate portion having a beveled upper surface;

the second fluid path comprising an inclined bore with the inlet being at a bottom of the base portion and the outlet at the beveled upper surface of the intermediate portion.

6. The apparatus of claim 5 wherein the second seal member is frusto-conical shaped and conforms to the beveled upper surface of the intermediate portion of the valve body member when the spring-biased push-button is not being depressed.

7. The apparatus of claim 6 and further including:

(a) a frusto-conical flexible spring member overlaying the second member;

(b) an elastomeric washer having a central opening for receiving the stem portion of the valve body member therethrough, the central opening of the washer engaging the stem portion; and (c) a cap cooperating with the valve-receiving socket of the means for suspending the container for covering the second seal member, the frusto-conical flexible spring member and the elastomeric washer.

8. The apparatus of claim 1 wherein the passage forming the first fluid path is a fine bore extending through a wall defining the valve receiving socket.

9. The apparatus of claim 5 wherein the passage forming the first fluid path is a fine bore extending through a wall defining the valve receiving socket.

10. The apparatus of claim 1 wherein the base portion of the valve body member includes a radially extending flange at an upper end thereof, the flange having at least one aperture extending through a thickness dimension thereof.

11. The apparatus of claim 10 and further including a tubular plunger coupling the spring-biased push-button to the base portion of the valve body member, the plunger having an annular wall defining a central lumen, there being a transverse bore extending through the wall to the lumen at a predetermined location there along.

12. The apparatus of claim 11 wherein the second seal member comprises an annular disk portion surrounding and sealed to the plunger, the disk portion overlaying the radially extending flange for occluding the at least one aperture when the plunger is not being depressed.

13. The apparatus of claim 12 wherein the means for suspending includes a bore defining a valve seat and the first flexible seal member includes a cone-shaped portion extending partially through the bore defining the valve seat and seated with respect to the valve seat when the push-button is not being depressed, depression of the push-button unseating the first seal member from the valve seat and displacing the second seal member from the at least one aperture in the flange.

14. The apparatus of claim 12 wherein the first seal member comprises an annular cup seal member disposed in surrounding relation to the base portion of the valve body member with a peripheral surface of the cup seal member forming a fluid tight seal with the valve receiving socket when the tubular plunger is not being depressed.

15. The apparatus of claim 1 wherein the compliant, compressible container includes a pattern of parallel, longitudinally extending ridges formed on an inner wall of the generally cylindrical body.

16. The apparatus of claim 1 wherein the first and second flexible seal members are disposed at opposed ends of a compressible bellows.

17. The apparatus of claim 16 and further including a third flexible seal member disposed in the valve receiving socket, said valve body member having a lumen and a tubular valve stem portion with a lumen and a third fluid path extending from an exterior of the valve stem portion to the lumen, the third flexible seal member occluding the third fluid path when the spring biased push button is not being depressed.

* * * * *